United States Patent [19]

Knapp

[11] Patent Number: 4,808,982

[45] Date of Patent: Feb. 28, 1989

[54] FACILITY FOR MONITORING THE OPERATION OF A SIGNAL LAMP

[75] Inventor: Hans J. Knapp, Korntal, Fed. Rep. of Germany

[73] Assignee: Alcatel N.V., Amsterdam, Netherlands

[21] Appl. No.: 892,686

[22] Filed: Aug. 1, 1986

[30] Foreign Application Priority Data

Aug. 2, 1985 [DE] Fed. Rep. of Germany ..... 3527828

[51] Int. Cl.[4] ..... G08B 21/00

[52] U.S. Cl. ..... 340/641; 340/642

[58] Field of Search ..... 324/118, 522, 556; 332/2, 3, 14, 20, 9 R; 315/83, 119, 120, 127, 129, 135, 136, 276, 362; 340/79, 80, 507, 641, 642, 825.16, 664, 310 A, 310 R; 323/301; 329/146; 246/1 C, 1 R, 34 CT, 121, 169 R, 473 R

[56] References Cited

U.S. PATENT DOCUMENTS

| | | | |
|---|---|---|---|
| 2,854,633 | 9/1958 | DeJager | 324/118 |
| 3,242,428 | 3/1966 | Brumley et al. | 324/118 |
| 3,334,296 | 8/1967 | Rogal et al. | 324/118 |
| 3,532,928 | 10/1970 | West | 315/83 |
| 3,631,441 | 12/1971 | Murphy | 315/136 |
| 3,679,975 | 7/1972 | Fein | 324/118 |
| 3,801,860 | 4/1974 | King | 315/276 |
| 3,868,075 | 2/1975 | Blazek et al. | 246/34 CT |
| 4,019,128 | 4/1977 | Chebowski | 340/642 |
| 4,156,848 | 5/1979 | Stimple et al. | 329/146 |
| 4,222,047 | 9/1980 | Finnegan | 315/136 |
| 4,245,215 | 1/1981 | O'Connor et al. | 340/310 A |
| 4,310,829 | 1/1982 | Rey | 340/310 A |
| 4,352,475 | 10/1982 | Smith et al. | 246/121 |
| 4,429,269 | 1/1984 | Brown | 323/301 |
| 4,611,291 | 9/1986 | Hoelscher | 340/664 |

OTHER PUBLICATIONS

Helmut Scherz, Wuppertal, "Eisenbahntechnische Praxis", 1959, No. 3, pp. 25 and 26.

*Primary Examiner*—Gerald L. Brigance
*Assistant Examiner*—Richard Hjerpe
*Attorney, Agent, or Firm*—Christie, Parker & Hale

[57] ABSTRACT

A facility for monitoring the operation of a signal lamp in the outdoor installation of an interlocking. Such signal lamps are powered through lamp transformers located in the immediate vicinity of the lamps. Monitoring for filament breaks is done on the primary side in the interlocking station. The monitoring poses problems in the case of great control distances because leading reactive currents occur on long leads. The invention uses a modulator in the secondary circuit of the lamp transformer which impresses on the lamp current a unique modulation pattern that is recognized in the interlocking station. In addition, the modulator may be turned on via a photocell responsive to the light of the signal lamp, and may perform additional control functions, such as turning on auxiliary light sources.

7 Claims, 2 Drawing Sheets

FACILITY FOR MONITORING THE OPERATION OF A SIGNAL LAMP

TECHNICAL FIELD

The present invention relates to a facility for monitoring the operation of a signal lamp.

BACKGROUND ART

Light signals in railway signalling systems must be operated on a fail-safe basis, i.e., their operation must be continuously monitored and any failure must be immediately detected and rendered ineffective by putting into operation a substitute signal, such as a secondary filament.

It is known (see, for example, "Eisenbahntechnische Praxis", 1959, No. 3, pp. 25 and 26) to operate each signal lamp via a separate lamp transformer which is located near the signal lamp and causes the supply circuit from the interlocking station to the signal control unit, where the circuit goes through the primary winding of the lamp transformer, to be not interrupted if the signal lamp fails due to a filament break. The lack of load on the secondary side of the lamp transformer only results in a reduction of the current in the supply circuit. This decrease of current can be detected and indicated by means of a monitoring facility consisting of a monitoring transformer having its primary winding included in the supply circuit and a monitoring relay connected to the secondary winding of the transformer. As stated in the article referred to above, the components required to operate the signal lamps must be precisely matched to be able to operate on a fail-safe basis. In addition, the supply voltages for the signal lamps must be accurately adjusted to the respective control distance, particularly if the signals are to be supplied at night with a lower voltage then by day. The control distance is limited to a value (6.5 km) which appears too small for large interlocking plants as are desirable today.

DISCLOSURE OF INVENTION

The object of the invention is to provide a facility with which the operation of a signal lamp can be monitored over a major distance without the need for any components with specific values and precisely set switching thresholds.

The monulator modulates on the signal-lamp current a sort of life sign whose presence can be determined in the interlocking station and indicates whether or not current is flowing in the secondary circuit of the lamp transformer. The modulator must be so designed that it cannot operate until the current in the secondary circuit is sufficient for operating the signal lamp. The monitoring circuit in the interlocking station must recognize the modulation effected by the modulator in a fall-safe manner.

In a particularly simple development of the facility according to the invention, the modulator is a blanking circuit which blanks individual half-waves of the signal-lamp current. This blanking can be effected in accordance with a given pattern that cannot be produced accidentally, so that the possibility of such a pattern being delivered as a result of a fault (such as undesired oscillation of a subcircuit) can be ruled out.

To be able to detect short circuits in the socket of the signal lamp, the operation of the modulator can be made dependent directly on the light output of the signal lamp, or the operating voltage for the modulator can be taken directly off the lamp socket.

A further embodiment of the facility according to the invention makes it possible to monitor two or more signal lamps with a single monitoring circuit. This is an advantage, for example, if the restricted aspect, which requires similtaneous operation of two signal lamps, is turned on.

Another development of the facility according to the invention permits other devices, such as auxiliary light sources, to be switched on if the signal lamp fails.

BRIEF DESCRIPTION OF DRAWINGS

Embodiments of the facility according to the invention will now be described with reference to the accompanying drawings, in which.

BEST MODE FOR CARRYING OUT THE INVENTION

Figure 1:
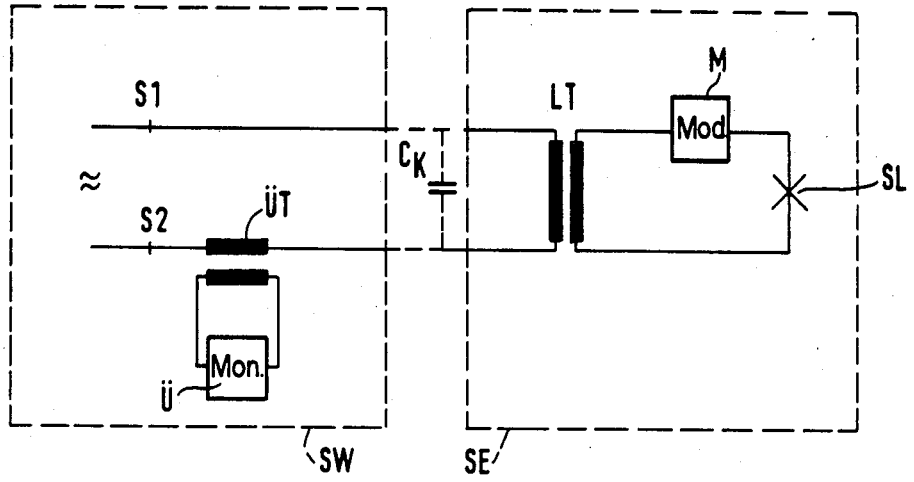
FIG. 1 shows a signal-lamp circuit with the facility according to the invention.

FIG. 1 is a schematic diagram of a signal-lamp circuit containing a signal lamp SL, a lamp transformer LT, and a modulator M in its outdoor portion, the signal control unit SW, and a monitoring circuit O and a monitoring transformer ÜT in the portion SW located in the interlocking station.

The signal-lamp circuit is subjected to an alternating voltage from the interlocking station as soon as the switches S1 and S2 are closed.

Current now flows through the primary windings of the lamp transformer LT and the monitoring transformer OT. In the secondary winding of the lamp transformer, an alternating voltage is induced which drives current through the signal lamp SL and the modulator M. A voltage is also induced in the secondary winding of the monitoring transformer ÜT, it is a measure of the current flowing in the signal-lamp circuit and is evaluated in the monitoring circuit.

In the prior art, where no modulator is used, the monitoring circuit contains a relay which releases when the current flowing in the signal-lamp circuit and, consequently, the voltage induced in the secondary winding of the monitoring transformer will fall below a predetermined value. Any break in the filament of the lamp, for example, increase the inductive reactance of the lamp transformer and, thus, causes the current flowing through the primary winding to drop. However, because of the internal losses of the lamp transformer and because of the cable capacitance, represented in the figure by a capacitor $C_K$, this current never drops to zero. Particularly if the interlocking station and the signal control unit are far apart. there is even the danger that the reactive current flowing through the cable capacitance will prevent the current from falling below the drop-out value of the monitoring relay, so that a filament break will go undetected.

By providing a modulator M in the vicinity of the lamp which modulates the signal-lamp current with a characteristic signal, and by providing a monitoring circuit Ü in the interlocking station which detects whether the signal-lamp current has been modulated with such a characteristic signal, it is possible to determine whether or not lamp-current is actually flowing between the interlocking station and the lamp.

The possibility that the modulation appears without the flow of signal-lamp current can be ruled out if the modulating signal does not have such a simple shape that it can be simulated by faulty operation of components (e.g., undesired oscillation).

Any break in the signal-lamp circuit is thus detected by the absence of the oscillation. Any short circuit (e.g., wire-to-wire fault) is detected if it causes the voltage necessary for operating the signal lamp to fall below a minimum value representing the modulator's response threshold.

Figure 2:
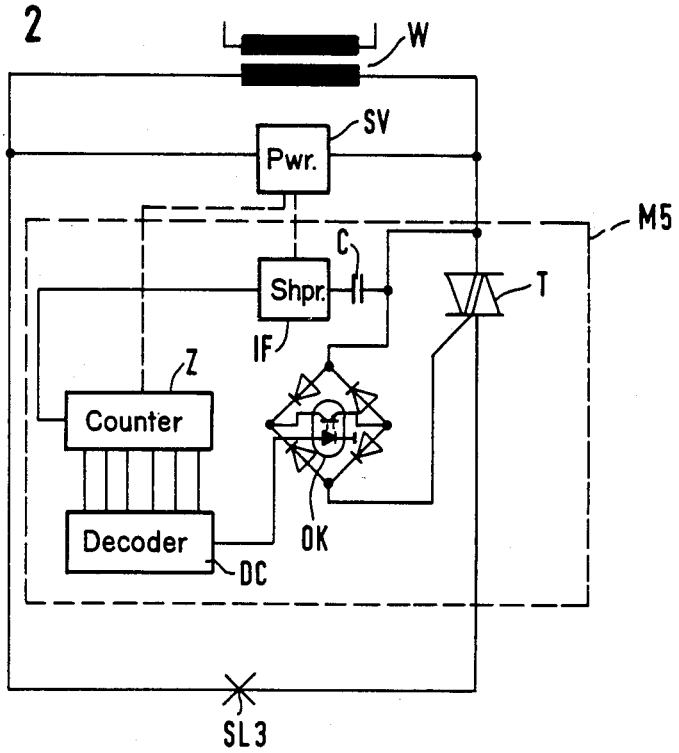
FIG. 2 is a block diagram of a simple modulator.

FIG. 2 shows an embodiment of a simple modulator. This modulator M5 contains a triac T, whose switching path lies in the lead to the signal lamp SL3, and a pulse shaper 1F, which is connected to the alternating voltage through a coupling capacitor C and applies pulses derived from the alternating voltage to a counter Z.

The outputs of the counter are connected to a decoder BC, whose output closes or opens the control path of the triac via an optocoupler inserted in the direct-current path of a bridge rectifier. Power is supplied o the pulse shaper an the counter by a power supply SV connected in parallel with the signal lamp.

In this modulator, the triac can be blocked for predetermined AC half-waves by means of the decoder. Particular patterns can be set which cannot be simulated by chance. If the signal lamp fails, the secondary winding W of the lamp transformer is loaded only by the power supply SV. The power consumption of the latter is low and, in addition, unmodulated. The failure will thus be detected. If a short circuit occurs, the modulater will either not operate at all, because it will receive no sufficiently high voltage, or deliver (in the event of a short circuit in the socket of the signal lamp) a sequence of short current pulses that has nothing in common with the modulation pattern. To detect short circuits in the socket by the absence of any modulation, the operation of the modulator may also be made dependent on the illumination of a photocell by the signal lamp.

Figure 3:
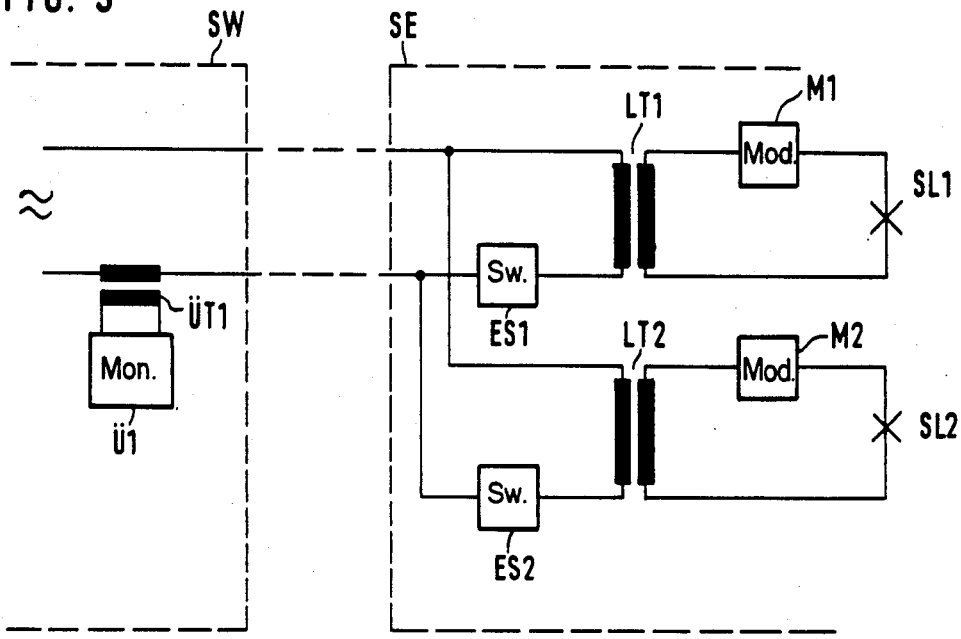
FIG. 3 shows a circuit with two signal lamps.

In FIG. 3, two lamp transformers LT1, LT2, two modulators M1, M2, and two signal lamps SL1, SL2 are shown in the signal control unit SE. The primary windings of the two transformers are powered from the same circuit, but they are connected to the circuit separately by power switches ES1, ES2. Here, cables can be saved if the power switches are controllable via control lines (not shown) or a serial data link (not shown). The two modulators produced patterns which can be distinguished one from the other and are recognized by the monitoring circuit Ü in the interlocking station. The monitoring circuit is preferably a fail-safe microcomputer system.

Figure 4:
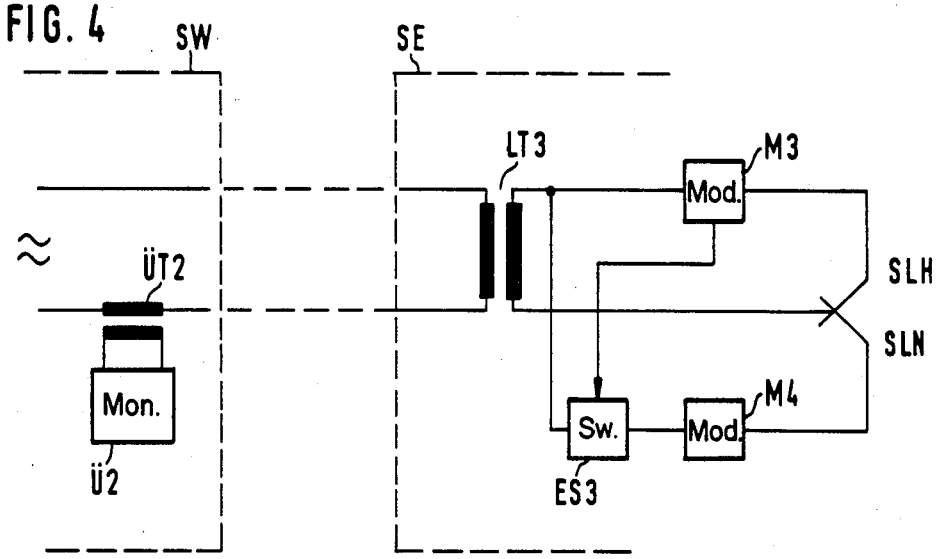
FIG. 4 shows a circuit with switched auxiliary light source.

FIG. 4 shows an embodiment in which one of the modulators, M3, has an additional control output via which the power switch ES3 of an additional signal-lamp circuit is controlled. For the case shown here, i.e., a signal lamp with a main filament SLH and a secondary filament SLN, the required interdependence thus follows automatically: The secondary filament, together with its modulator M4, will be turned on only if the modulator M3 delivers no modulating signal, i.e., if the main filament is broken.

I claim:

1. Apparatus for monitoring the operation of a signal lamp located in an outdoor installation connected by a supply circuit to a remotely located interlocking station, comprising a lamp transformer forming part of said outdoor installation and having its primary winding in series with the supply circuit and supplying power to the signal lamp from its secondary winding, a modulator which modulates the lamp current in a distinctive, predetermined manner connected in series with the signal lamp and with the secondary winding of the transformer, whereby said supply circuit is supplied with a predetermined distinctive signal if and only if lamp current is flowing through said secondary winding, through said modulator and through the signal lamp, and a monitoring circuit located in the interlocking station which is coupled to a portion of the supply circuit within the interlock station and responds to the predetermined distinctive signal and which delivers a fault message indicative of a failure in the signal lamp or its associated circuitry if the monitoring circuit does not detect said corresponding predetermined distinctive signal in the interlocking station portion of the supple circuit.

2. An apparatus as claimed in claim 1, wherein the modulator is a blanking circuit which blanks individual half-waves of the signal lamp current in accordance with a predetermined pattern.

3. An apparatus as claimed in claim 1, wherein the monitoring circuit is of multichannel design and is capable of detecting several different modulation patterns.

4. An apparatus as claimed in claim 1, wherein the modulator has an additional output through which a signal for controlling other switching devices is delivered during operation of the modulator.

5. Apparatus for monitoring the operation of a signal lamp located in an outdoor installation connected by a supply circuit to a remotely located interlocking station, comprising a lamp transformer forming part of said outdoor installation and having its primary winding included in the supply circuit and supplying power to the signal lamp from its secondary winding, a light-sensitive cell which is included as part of said outdoor installation and which is responsive to illumination resulting from the lamp current flowing through the lamp a modulator also included as part of said outdoor installation which is coupled to said supply circuit and to said light-sensitive cell and is activated only in response to the detection by said light-sensitive cell of a predetermined minimum illumination from the lamp to modulate the lamp current in a distinctive, predetermined manner, whereby said supply circuit is supplied with a predetermined distinctive signal if and only if said lamp is illuminated above a predetermined minimum level, and a monitoring circuit located in the interlocking station which is coupled to the supply circuit and tuned to the distinctive, predetermined modulation and which delivers a fault message indicative of a failure in the signal lamp or its associated circuitry if the monitoring circuit does not detect said distinctive, predetermined modulation.

6. An apparatus as claimed in claim 5, characterized in that the monitoring circuit is of multichannel design and is capable of detecting several different modulation patterns.

7. An apparatus as claimed in claim 5, characterized in that the modulator has an additional output through which a signal for controlling other switching devices is delivered during operation of the modulator.

* * * * *